US006050008A

United States Patent [19]

Doornek et al.

[11] Patent Number: 6,050,008

[45] Date of Patent: Apr. 18, 2000

[54] VEHICLE MOUNTED ACCESSORY ASSEMBLY

[75] Inventors: James R. Doornek, Mequon; Steven L. Klug, Milwaukee; Gerald E. Lutzke, Sheboygan; Chad T. Barker, Caledonia; Christian T. Nielsen, Waukesha, all of Wis.

[73] Assignee: Douglas Dynamics, L.L.C., Milwaukee, Wis.

[21] Appl. No.: 08/938,004

[22] Filed: Sep. 12, 1997

Related U.S. Application Data

[60] Provisional application No. 60/026,072, Sep. 13, 1996.

[51] Int. Cl.[7] ..... E01H 5/04

[52] U.S. Cl. ..... 37/231; 37/271; 37/236; 280/86.1

[58] Field of Search ..... 37/231, 234, 235, 37/236, 253, 266, 270, 271; 280/86.1; 172/452, 810, 811, 817, 819, 253, 247

[56] References Cited

U.S. PATENT DOCUMENTS

| | | | |
|---|---|---|---|
| 1,277,542 | 9/1918 | Cameron | 280/86.1 |
| 1,738,032 | 9/1929 | Bising | 37/232 |
| 1,786,974 | 12/1930 | Abbe | 37/232 |
| 2,040,121 | 5/1936 | Bowen | 16/44 |
| 2,055,794 | 9/1936 | Hewitt | 37/43 |
| 2,061,585 | 11/1936 | Meyer | 37/42 |
| 2,094,515 | 9/1937 | Abbe | 37/42 |
| 2,105,246 | 1/1938 | Horsfield | 280/86.1 X |
| 2,152,092 | 3/1939 | Rougier | 37/44 |
| 2,350,437 | 6/1944 | Wiedman | 37/44 |
| 2,420,591 | 5/1947 | Frame et al. | 37/42 |
| 2,431,410 | 11/1947 | Maxim | 37/44 |
| 2,442,831 | 6/1948 | Suttles | 16/44 |
| 2,513,231 | 6/1950 | Bourne | 37/44 |
| 2,707,795 | 5/1955 | Skupas | 16/44 |
| 2,754,601 | 7/1956 | Meyer | 37/44 |
| 3,095,212 | 6/1963 | Gilbert | 280/86.1 X |
| 3,307,275 | 3/1967 | Simi | 37/42 |
| 3,426,458 | 2/1969 | Spitzer | 37/42 |
| 3,559,827 | 2/1971 | Schier | 214/86 |
| 3,689,101 | 9/1972 | Spence | 280/96.2 R |
| 3,747,950 | 7/1973 | Hager | 280/86.1 |
| 3,793,752 | 2/1974 | Snyder | 37/42 R |
| 3,845,577 | 11/1974 | Naymik | 37/42 VL |
| 4,187,624 | 2/1980 | Blau | 37/42 R |
| 4,259,794 | 4/1981 | Rath | 37/42 |
| 4,470,211 | 9/1984 | Rossmann | 37/231 |
| 4,491,338 | 1/1985 | Sheldrake | 280/86.1 X |
| 4,512,593 | 4/1985 | Ehrhardt | 280/460 R |
| 4,528,762 | 7/1985 | Sarka et al. | 37/236 |
| 4,559,669 | 12/1985 | Bonzer et al. | 16/44 |
| 4,570,366 | 2/1986 | Yost | 37/232 |
| 4,685,174 | 8/1987 | Hager | 16/44 |
| 4,763,910 | 8/1988 | Brandli et al. | 280/29 |
| 4,821,435 | 4/1989 | Pester | 37/231 |
| 4,873,775 | 10/1989 | Richey | 37/231 |
| 4,905,387 | 3/1990 | Street | 37/271 |

(List continued on next page.)

OTHER PUBLICATIONS

Brochure, "ALIBION" Institutional and Industrial Casters and Wheels, Albion Industries, Incorporated, Albion, Michigan,p. 25, 1995.

Brochure, "We didn't invent the wheel . . . we just make use of it!", Tuff Tow, Prior Lake, Minnesota.

*Primary Examiner*—Victor Batson
*Attorney, Agent, or Firm*—Michael Best & Friedrich LLP

[57] ABSTRACT

A vehicle mounted accessory unit assembly is provided that is removably mountable to a vehicle, the accessory assembly including a support frame having a first and second portion that are connected at a pivot point, with the pivot point enabling forces to be directed in such a way as to minimize the stresses on the vehicle to which the accessory unit assembly is attached. The accessory unit assembly further includes a wheel assembly to further minimize the stresses on the vehicle. The wheel assembly preferably includes a ground engaging wheel, a mounting member, a spring assembly and a dampener. A steering dampener is also utilized.

53 Claims, 10 Drawing Sheets

U.S. PATENT DOCUMENTS

| | | | |
|---|---|---|---|
| 4,944,104 | 7/1990 | Kowalczyk | 37/231 |
| 4,948,162 | 8/1990 | McCanse | 280/86.1 |
| 5,046,271 | 9/1991 | Daniels | 37/236 X |
| 5,075,988 | 12/1991 | Ciula | 37/236 X |
| 5,136,795 | 8/1992 | Rosenberg | 37/233 |
| 5,193,296 | 3/1993 | Reilly | 37/236 X |
| 5,195,261 | 3/1993 | Vachon | 37/236 X |
| 5,251,390 | 10/1993 | Wong | 37/231 |
| 5,347,680 | 9/1994 | Rippe | 16/19 |
| 5,400,469 | 3/1995 | Simonsen | 16/44 |
| 5,666,747 | 9/1997 | MacQueen | 37/231 X |
| 5,806,213 | 9/1998 | Doornek et al. | 37/236 X |
| 5,806,214 | 9/1998 | Behrens et al. | 37/231 |

160
162
164
166
168
170
172
174
176
178
180
182
184
186
188
190
192
194
196
198
200
202
204
206
208
210
212
214
216
218
220
222
224
226
228
230
232
40
10
11

VEHICLE MOUNTED ACCESSORY ASSEMBLY

RELATED APPLICATION

This application claims priority from prior filed provisional application Ser. No. 60/026,072, filed Sep. 13, 1996.

FIELD OF THE INVENTION

The invention relates to vehicle mounted accessory assemblies, and more particularly, to vehicle mounted accessory assemblies that are supported by both the vehicle and a ground engaging wheel.

BACKGROUND OF THE INVENTION

Vehicle mounted accessory assemblies such as snowplows have been traditionally mounted to heavy duty trucks. Such snowplows are not normally mounted to lightweight vehicles such as automobiles, light trucks and sport utility vehicles because the weight of the snowplow and its supporting frame tends to over stress the vehicle and, particularly, over stress the vehicle's front end suspension.

Casters have been used for many years to support vehicle mounted snowplows after detachment from the vehicle. One problem with transporting snowplows having casters is an oscillation or shimmy that occurs when the ground engaging wheel is off set from a center alignment such as by an uneven surface, obstruction or the like. This oscillation can be undesirable as well as stress the structure of the snowplow assembly decreasing its operational life.

SUMMARY OF THE INVENTION

The invention provides for a vehicle mounted accessory assembly that is removably mountable to a vehicle. The assembly includes a support frame to which an accessory unit such as a snowplow blade and an actuator is secured. The support frame includes a first frame portion and a second frame portion connected to each other at a pivot point remote from the vehicle. The pivot point enables forces to be directed in such a way as to minimize the stresses on the vehicle to which the accessory assembly is mounted.

The vehicle mounted accessory assembly further includes a ground engaging wheel to absorb some of the impact on the accessory unit and therefore minimize the stresses on the vehicle. The wheel is highway rated such that it engages the ground when the accessory unit is being transported on the vehicle and when the accessory unit is being used for its intended application. The wheel is mounted to the support frame by a wheel mounting assembly. The wheel mounting assembly includes a mounting member, a spring and a dampener. The spring and dampener limit the range of movement of the wheel. The wheel mounting member may also include a steering dampener having one end secured to the mounting member and having a second end secured to the support frame. The king pin dampener minimizes and eliminates oscillation of the ground engaging wheel.

It is an object of the present invention to provide a new and improved vehicle mounted accessory assembly.

It is another object of the present invention to provide a vehicle mounted accessory assembly that minimizes the stresses on a vehicle to which it is mounted and particularly, minimizes stresses in the vehicle's front end suspension.

It is another object of the present invention to provide a vehicle mounted accessory assembly that utilizes a two portion pivoting support frame.

It is another object of the present invention to provide a vehicle mounted accessory assembly that utilizes a ground engaging wheel to support the accessory unit and minimize the forces on the vehicle both when the unit is in use and when the unit is being transported on the vehicle.

It is another object of the present invention to provide a vehicle mounted accessory assembly which includes a ground engaging wheel with a wheel mounting assembly which utilizes a dampener and a spring.

It is another object of the present invention to provide a vehicle mounted accessory assembly which includes a ground engaging wheel in which there is a positive stop on the movement of the wheel in both the upward and the downward vertical directions.

It is another object of the present invention to provide a vehicle mounted accessory assembly which includes a ground engaging wheel in which there is dampening on the upward and downward movement of the wheel.

It is another object of the present invention to provide a vehicle mounted accessory assembly having a frame that includes a pivot point that directs plowing forces into a ground engaging wheel.

It is another object of the present invention to provide a vehicle mounted accessory assembly wherein the pivot point of the accessory unit is remote from the vehicle.

It is another object of the present invention to provide a vehicle mounted accessory assembly which includes a highway rated ground engaging wheel with a dampener to minimize oscillations of the wheel.

It is another object of the present invention to provide a vehicle mounted accessory assembly which includes a ground engaging wheel with a dampener in operational engagement with the rotating king pin of the wheel and in engagement with a frame of the vehicle mounted accessory assembly.

It is another object of the present invention to provide a vehicle mounted accessory assembly which includes a ground engaging wheel with a dampener in operational engagement with the rotating king pin of the wheel to provide rotational dampening.

It is another object of the present invention to provide a vehicle mounted accessory assembly wherein the assembly is mounted to the vehicle under the vehicle near the front axle.

Other features and advantages of the invention will become apparent to those of ordinary skill in the art upon review of the following drawing, detailed description and claims.

Figure 1:
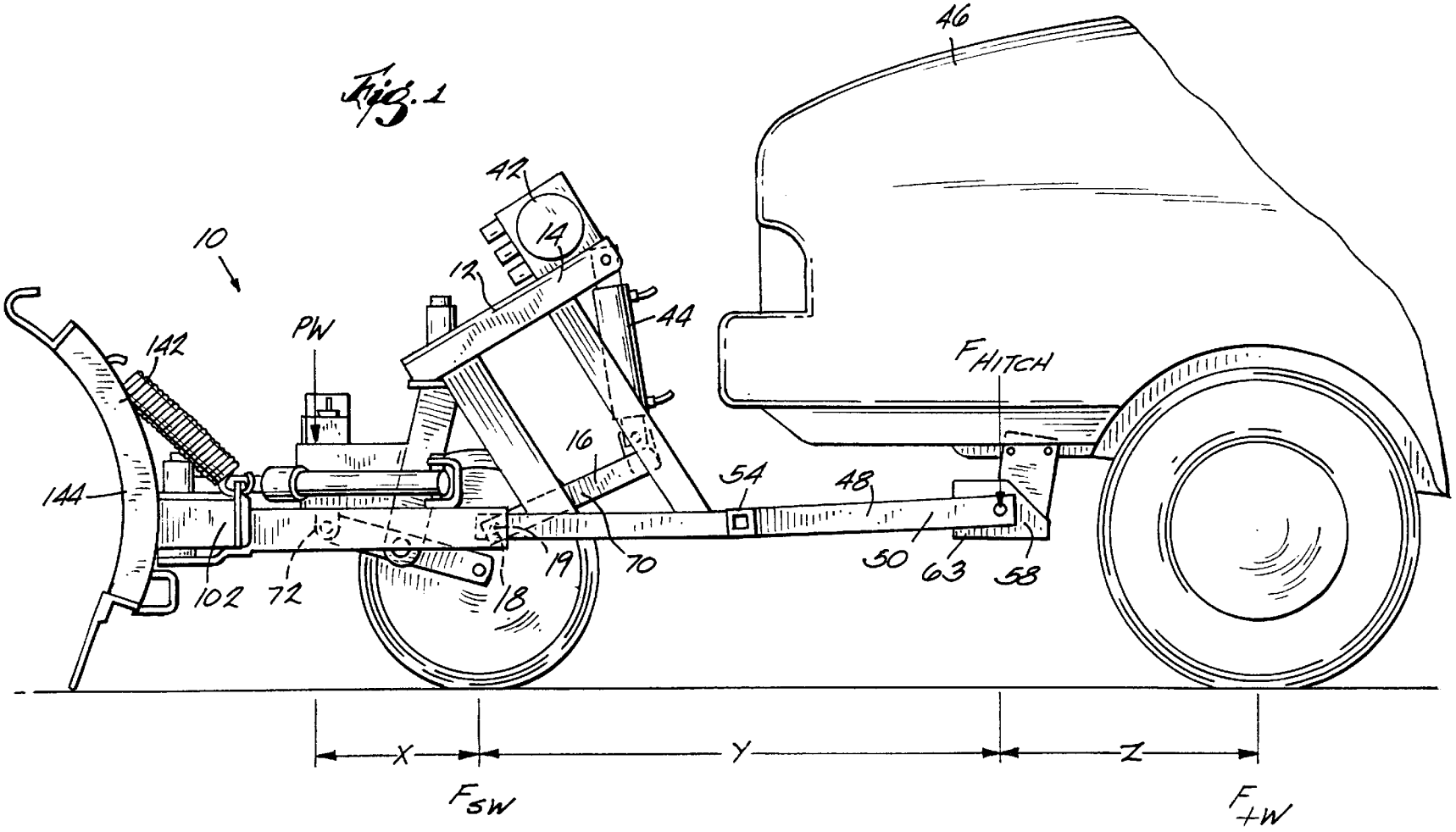
FIG. 1 is a side view of a vehicle mounted accessory assembly including a ground engaging wheel and with an attached snowplow blade in a blade down position.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Referring now to the drawings, there is shown a vehicle mounted accessory unit assembly 10 embodying the invention. The accessory unit assembly 10 can be used with a variety of different accessory units such as, for example, a snowplow blade, sweeper, saltspreader and vacuum. The accessory unit assembly 10 will be hereafter described in conjunction with a snowplow blade. However, it should be noted that the vehicle mounted accessory assembly is not limited to only that type of accessory unit.

Figure 3:
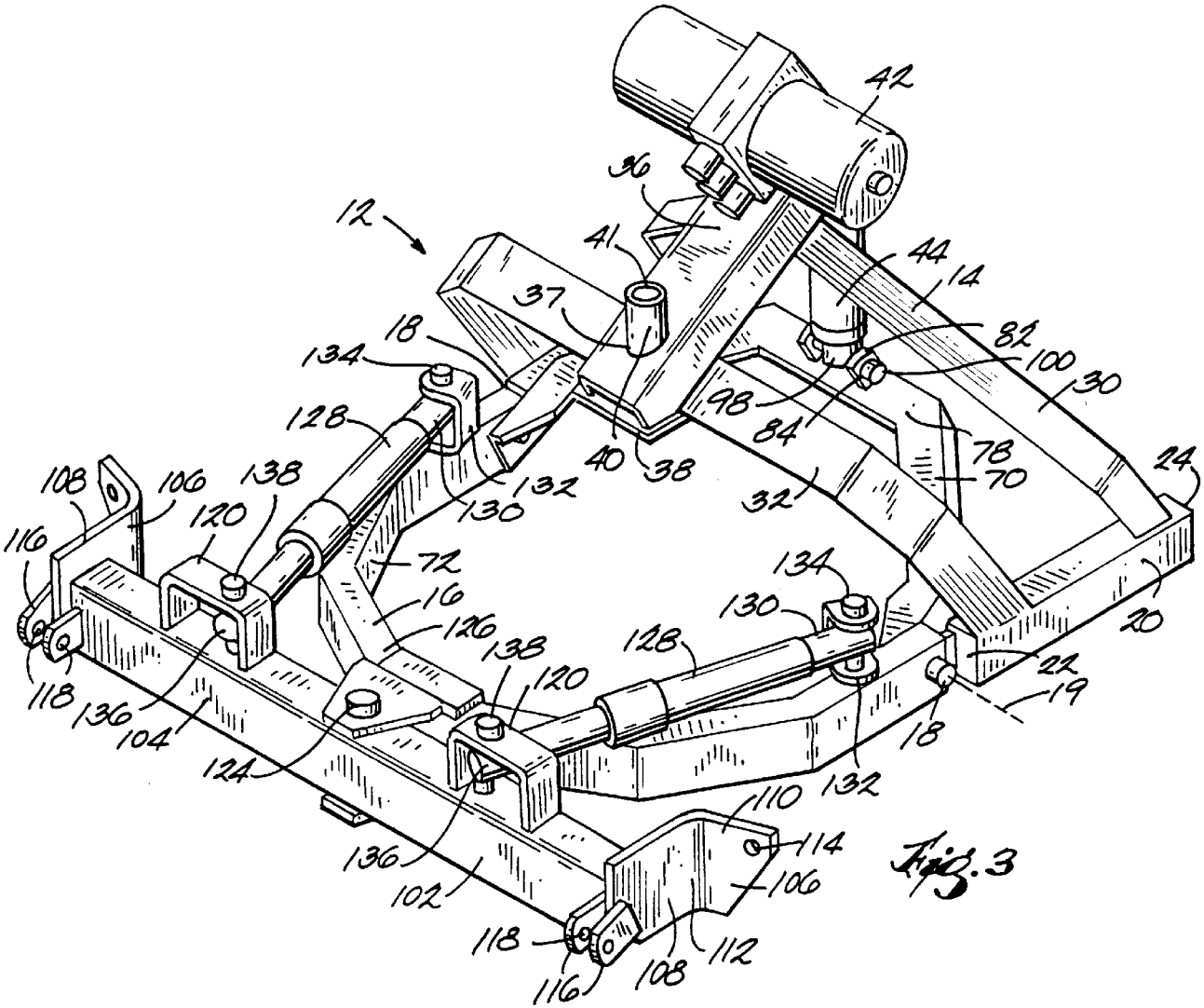
FIG. 3 is a perspective view of a support frame of the vehicle mounted accessory assembly.

Referring to FIGS. 1 and 3, the accessory unit assembly 10 includes a support frame 12. The support frame 12 includes a first portion or carriage 14 and a second portion or pivot frame 16. The carriage 14 and the pivot frame 16 are pivotally connected by a pair of pivot pins 18 such that the pivot frame 16 pivots or rocks about a pivot axis 19 with respect to the carriage 14.

Figure 5:
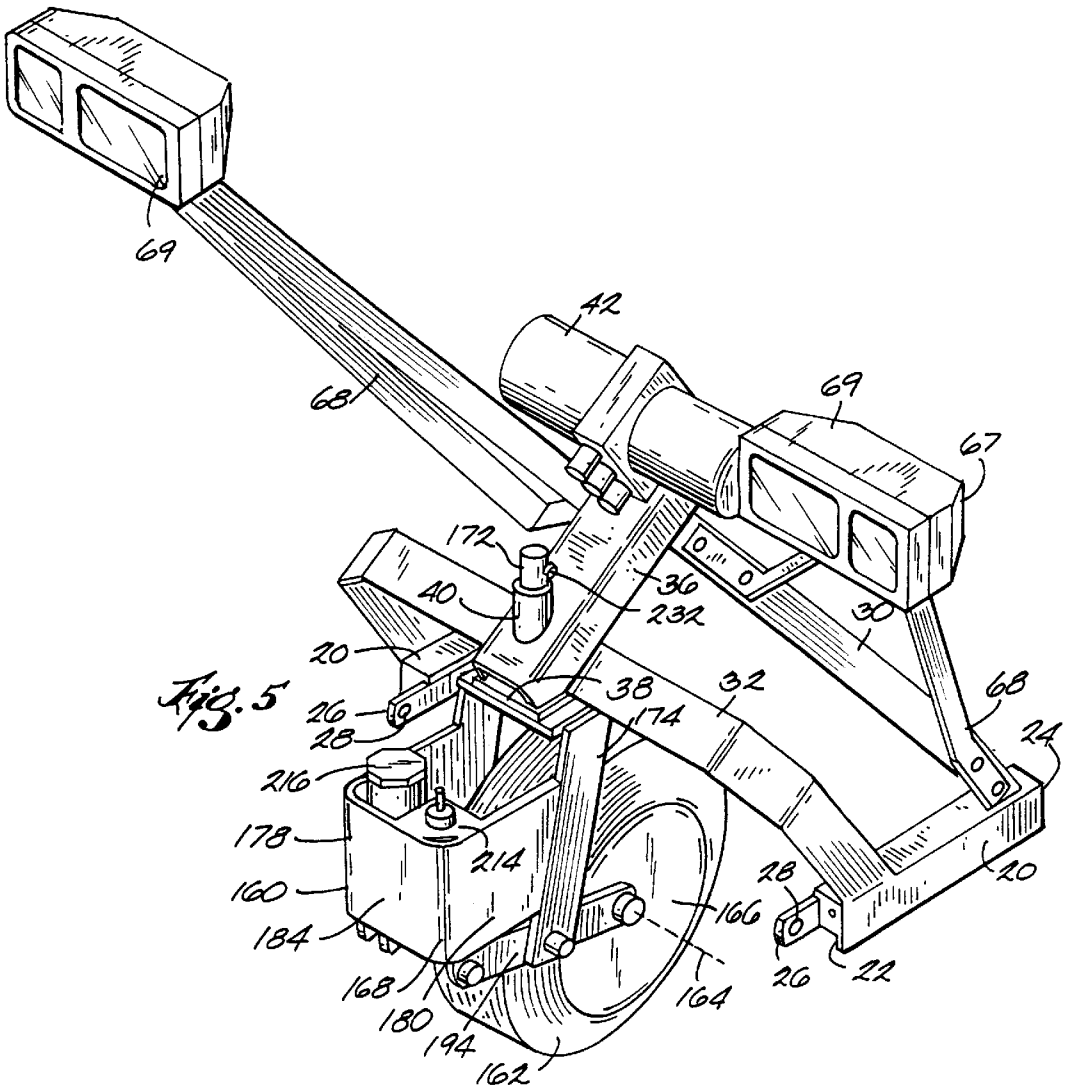
FIG. 5 is a perspective view of a carriage, the ground engaging wheel and the wheel mounting assembly.

With specific reference to FIGS. 3 and 5, the carriage 14 includes a pair of spaced side rails 20. Each side rail 20 has a first end 22 and a second end 24. A projection 26 extends outwardly from the first end 22 of each side rail 20. Each projection 26 has therethrough an aperture 28. A pair of generally V-shaped support rails 30 and 32 extend between and above the side rails 20. Each rail 30 and 32 is at an angle with respect to a perpendicular to the respective side rail 20 with that angle preferably on the order of approximately 45–65 degrees, and most preferably 57 degrees.

Figure 12:
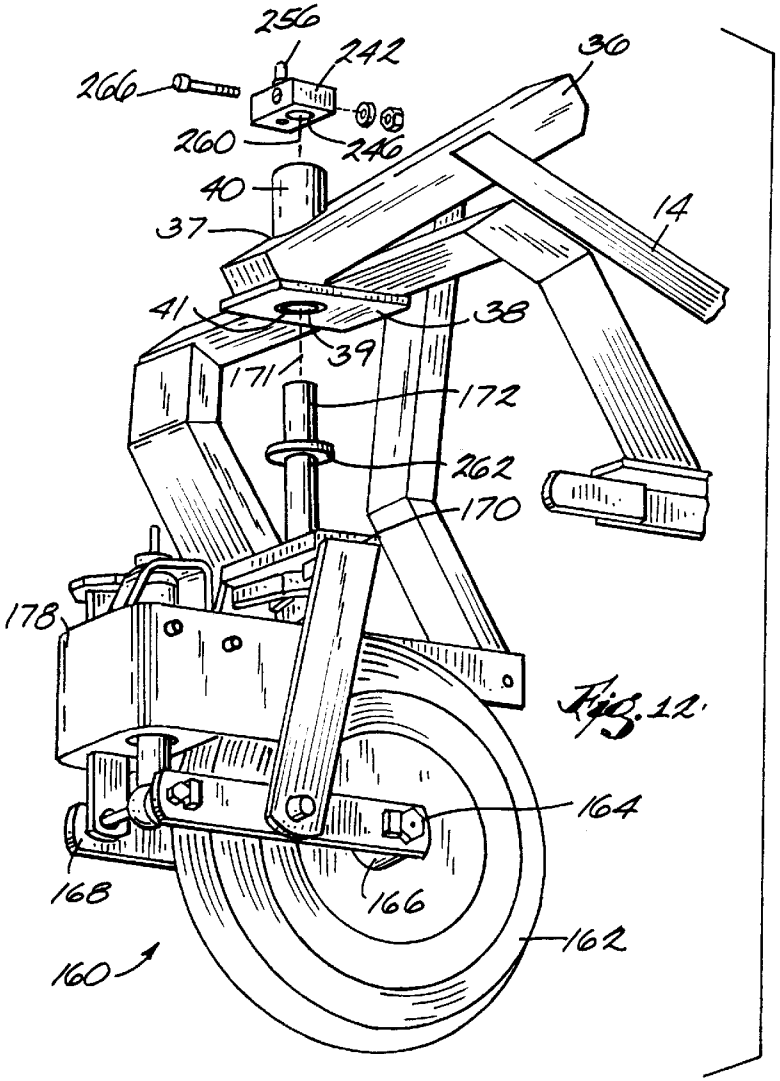
FIG. 12 is a perspective view of a portion of the carriage, the ground engaging wheel and the wheel mounting assembly.

A mounting rail 36 extends between the rails 30 and 32. The mounting rail 36 is preferably U-shaped in cross-section and has therethrough a circular aperture 37. A mounting plate 38 is positioned below the mounting rail 36 (FIG. 12). The mounting plate 38 includes an aperture 39 that is aligned with the aperture 37 of the mounting rail 36. A cylindrical member 40 extends upwardly from the mounting plate 38 and is aligned with the aperture 39 of the mounting plate 38 and the aperture 37 of the mounting rail 36. The aperture 39, cylindrical member 40 and aperture 37 defined a bore 41.

In the snowplow blade application, the mounting rail 36 partially supports an actuator designed to raise and lower a snowplow blade. Preferably, the actuator is hydraulic. With reference to FIG. 3, the mounting rail 36 supports a conventional hydraulic power unit 42. A actuator 44 such as a hydraulic cylinder depends from and is operationally connected to the hydraulic power unit 42.

As shown in FIG. 5, a pair of light fixture assemblies 67 is secured to the carriage 14. Each light fixture assembly 67 includes support rails 68 and a headlamp 69.

Referring back to FIGS. 3 and 4, the pivot frame 16 in the preferred embodiment is generally O-shaped in configuration. It should be noted, however, that the pivot frame 16 can have other configurations in addition to the illustrated O-shape, such as rectangular. Specifically, the pivot frame 16 includes first and second generally C-shaped frames 70 and 72. The frame 70 includes a first end 74, a second end 76 and a center portion 78 therebetween. A pair of spaced upwardly extending projections 82 extend upwardly from the center portion 78. Each projection 82 has therethrough an axially aligned aperture 84.

The frame 72 includes a first end 86, a second end 88 and a center portion 90 therebetween. The frame 70 and the frame 72 are fixedly secured together, such as by welding, by aligning the end 74 of the frame 70 with the end 88 of the frame 72. Similarly, the end 76 of frame 70 is aligned with the end 86 of the frame 72 and fixedly secured together, such as by welding, to maintain this orientation. Preferably, the frame 70 is oriented at an angle with respect to the frame 72 with that angle being preferably on the order of generally 10 to 30 degrees and more particularly on the order of approximately 20 degrees.

As best shown in FIGS. 1 and 3, the carriage 14 and the pivot frame 16 are pivotally connected with pivot pins 18 which define the pivot axis 19. Preferably, the projections 26 of each side rail 20 interengage with the pivot pin 18 to pivotally connect the carriage 14 to the pivot frame 16. After the carriage 14 and the pivot frame 16 are pivotally connected, an end 98 of the actuator 44 is secured to the projections 82 of the center portion 78 of the frame 70 of the pivot frame 16. The actuator 44 is secured to the projections 82 through use of a fastener 100 and the apertures 84 in the projections 82.

Figure 4:
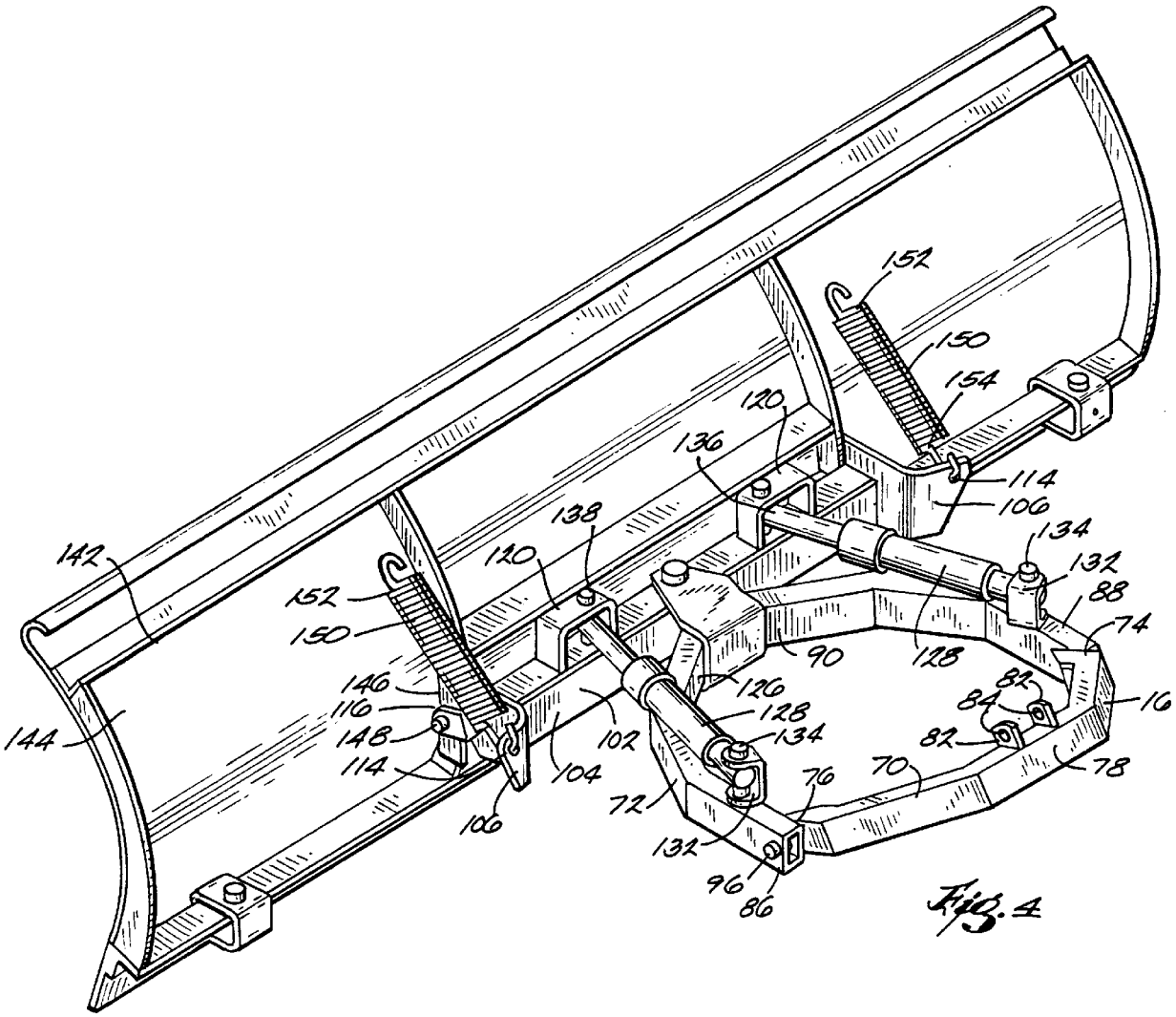
FIG. 4 is a perspective view of a pivot frame with the attached snowplow blade.

Referring now to FIGS. 3 and 4, the accessory unit assembly 10 further includes an accessory mount or quadrant 102 secured to the pivot frame 16. The quadrant 102 includes an elongate arm 104 having a mounting assembly 106 on each end. Each mounting assembly 106 includes a generally L-shaped bracket 108 secured to the arm 104. Each bracket 108 includes a first leg 110 and a second leg 112. The leg 110 has therethrough an aperture 114. A pair of projections 116 extend outwardly from the second leg 112 and quadrant 102. Each projection 116 has therethrough an axially aligned aperture 118. A pair of generally U-shaped brackets 120 are attached to and extend upwardly from the arm 104.

A central bracket 124 extends outwardly from the central portion 90 of frame 72. The bracket is generally U-shaped and houses a central portion of quadrant 102. The quadrant 102 is pivotally connected to bracket 124 using a suitable fastener such as a pivot pin.

As best shown in FIG. 4, the quadrant 102 is secured to the pivot frame 16. Specifically, the center portion 90 of the frame 72 is positioned in the passageway 126. A pair of actuators or angle rams 128 extend from the pivot frame 16 to the quadrant 102. A first end 130 of each ram 128 is pivotally connected to the frame 72 with a bracket 132 and a fastener such as a pivot pin 134. A second end 136 of each ram 128 is positioned between the bracket 120 and the arm 104 and pivotally connected with a suitable fastener such as pivot pin 138.

Continuing to refer to FIG. 4, a plow blade assembly 142 is pivotally connected to the quadrant 102. The plow blade assembly 142 includes the plow blade 144 which is pivotally connected to the quadrant 102 at the mounting assemblies 106 at each end of the arm 104. A portion 146 of the plow blade is positioned between the projections 116 and a fastener such as 148 maintains the portion 146 and the projections 116 in this orientation. The plow blade assembly 142 further includes a pair of trip springs 150. A first end 152 of each spring 150 interengages with the plow blade 144. A second end 154 of each spring 150 interengages with the aperture 114 in the respective mounting assembly 106.

It should be noted that the quadrant 102 can be of varying configurations depending upon the type of accessory unit used. The role of the quadrant 102 is to secure the chosen accessory unit to the pivot frame 16.

Figure 6:
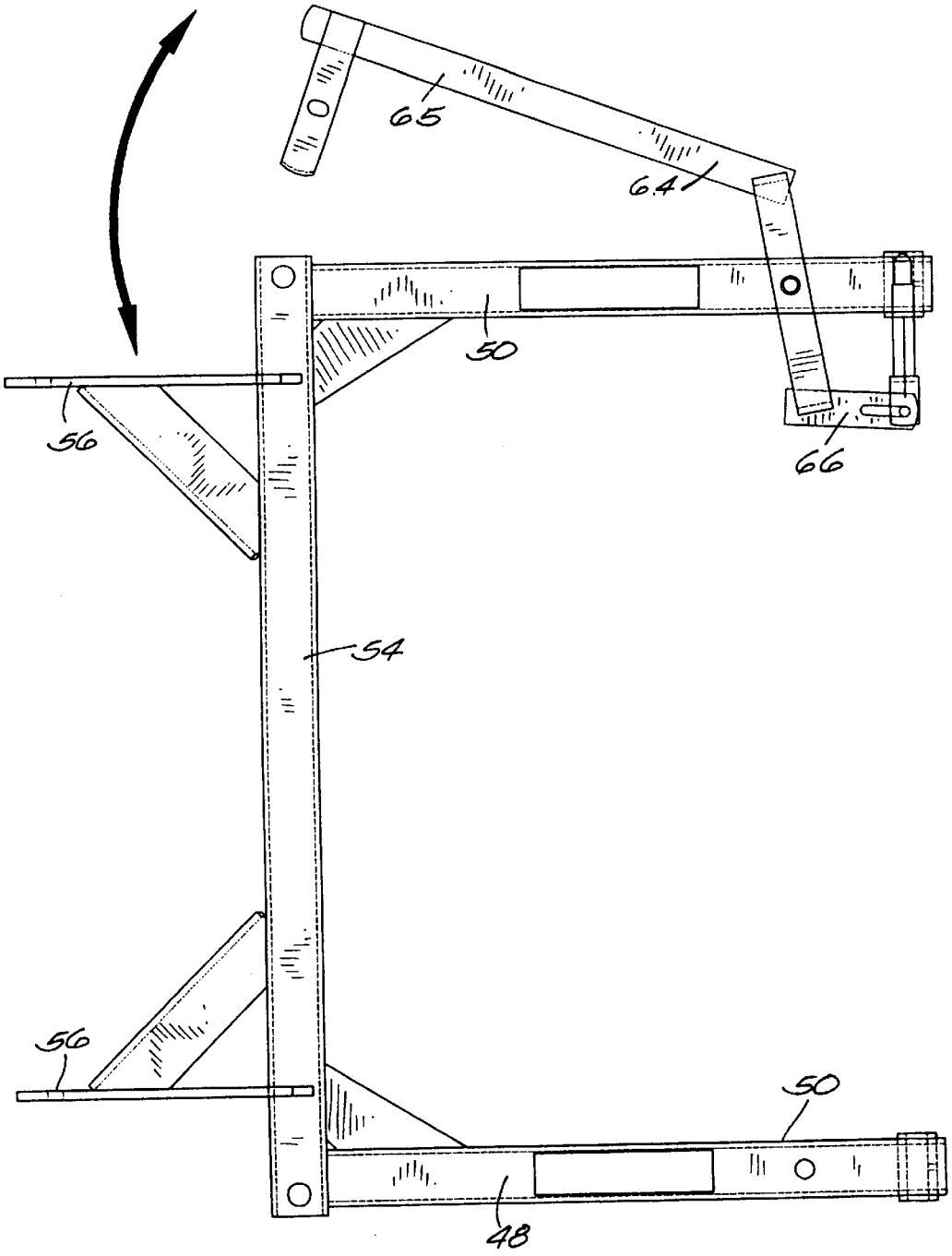
FIG. 6 is plan view of a plow mount.

As shown in FIGS. 1 and 6, the support frame 12 is removably secured to a vehicle 46 with a plow mount 48. The plow mount 48 enables the pivot axis 19 to be moved further outwardly from the front end of the vehicle 46. The plow mount 48 includes a pair of spaced generally parallel side members 50 and a cross member 54 extending therebetween. The members 50 and 54 are oriented so that the plow mount 48 is generally C-shaped. A pair of mounting plates 56 extend outwardly from the cross member 54 in a direction away from the side members 50.

As shown in FIG. 1, the plow mount 48 is secured to the carriage 14 through use of the mounting plates 56. One mounting plate 56 is secured to each side rail 20 with a suitable fastener such as a nut and bolt.

Figure 7:
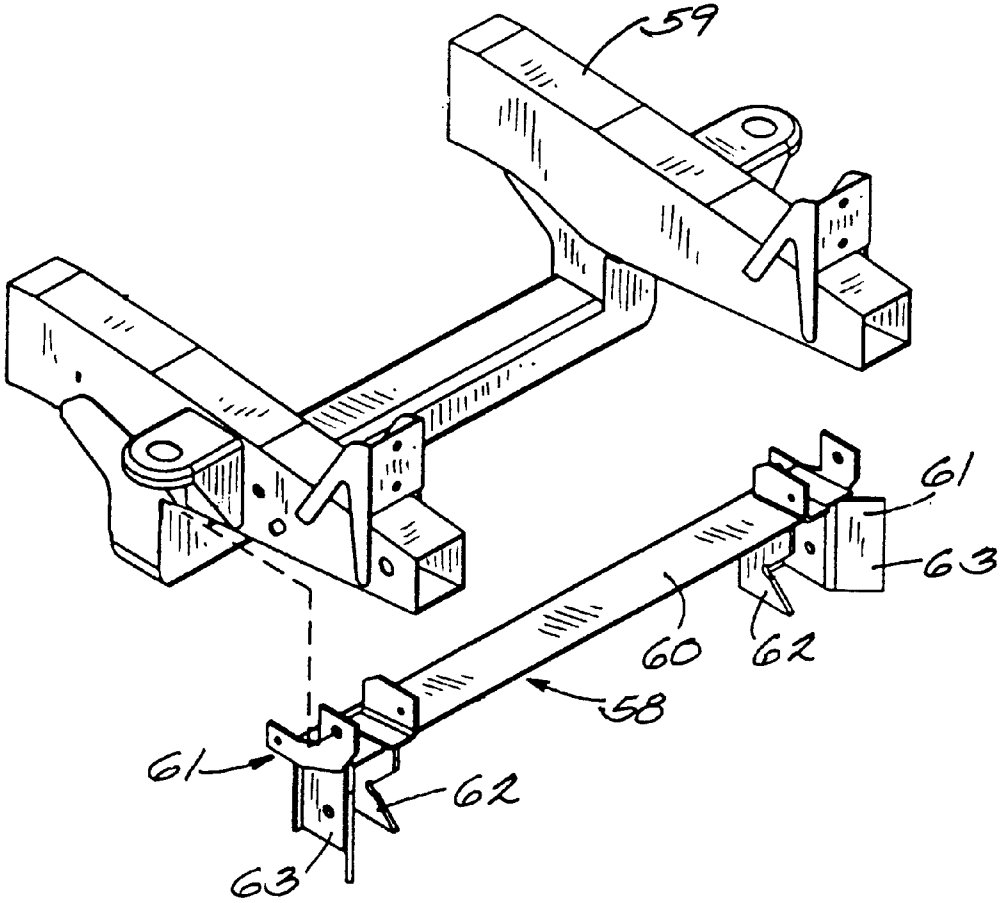
FIG. 7 is a perspective view of a vehicle mount adjacent a vehicle's frame horns.
Figure 8:
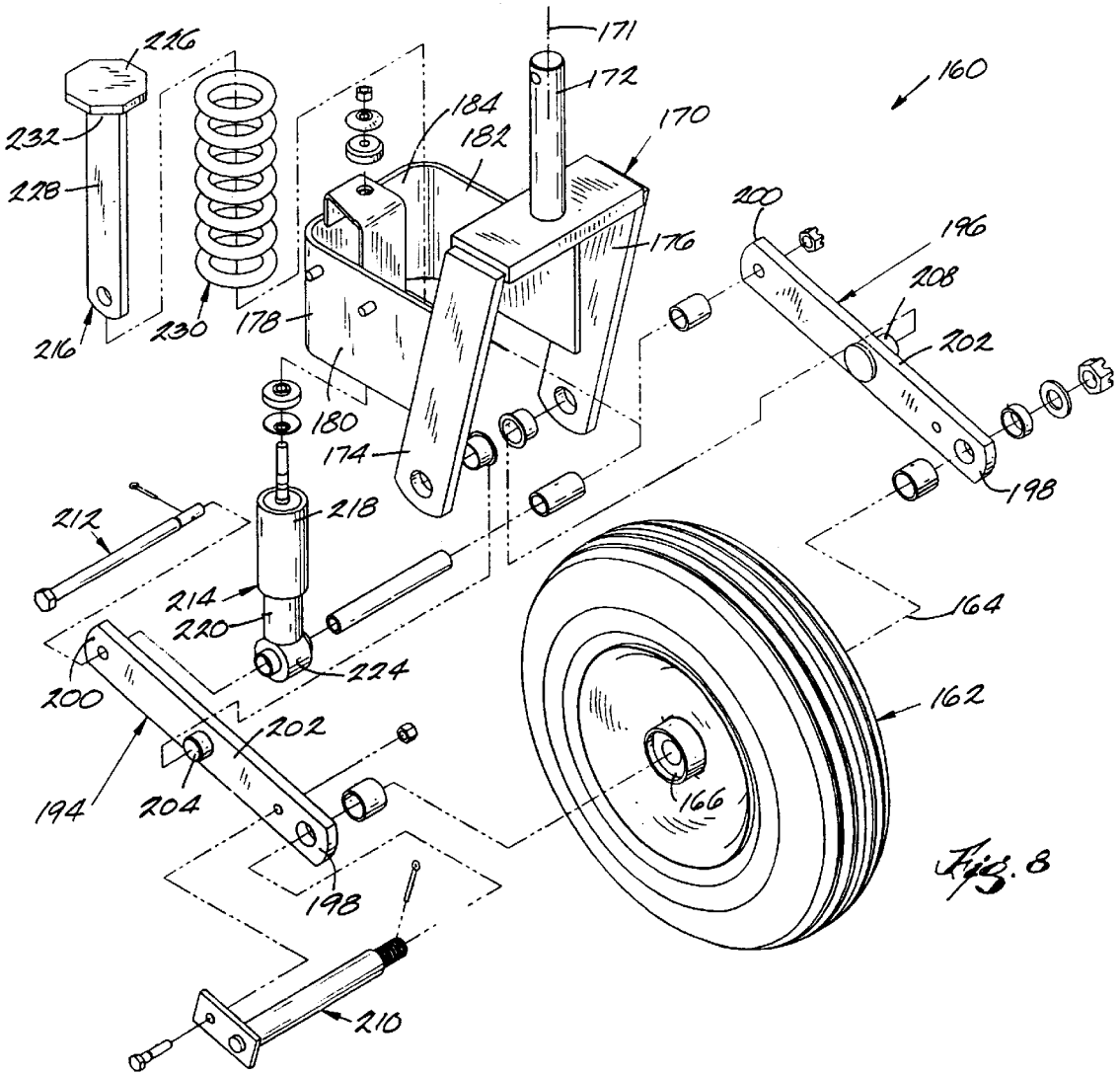
FIG. 8 is an exploded perspective view of the ground engaging wheel and wheel mounting assembly.

Referring now to FIG. 7, a vehicle mounting member 58 is utilized to secure the accessory unit assembly 10 to the vehicle 46. Preferably, the mounting member 58 is fixedly secured to the vehicle's frame horns 59 in the front portion of the vehicle 46 with suitable fasteners. The mounting member 58 includes a cross member 60 and a pair of mounting brackets 61 on each end of the cross member 60. The mounting brackets 61 each include a pair of generally parallel plates 62 and 63 with one plate 62 having therein a V-shaped recess and the other plate 63 having therethrough an aperture. When the accessory unit assembly 10 is to be secured to the vehicle 46, the plow mount 48 is pivotally connected to the mounting member 58 such as through the use of a pivot pin.

Preferably, the mounting member 58 is positioned near the front axle of the vehicle 46 so as to be a distance from the bumper under the vehicle 46. As shown in FIG. 6, for convenience, a remote latching mechanism 64 is attached to each side member 50 (only one of which is shown in FIG. 6) and enables securing of the accessory unit assembly 10 to the vehicle 46 without a user having to crawl under the vehicle 46 to insert a pivot pin through each side member 50 and through a respective portion of the vehicle mounting member 58.

The remote latch mechanism 64 as shown in FIG. 6 is operated by movement a hitch arm 65. When the end of each side member 50 of the plow mount 48 is positioned between the respective pair of plates 62 and 63 of the vehicle mounting member 58, movement of the hitch arm 65 in the direction of the respective side member 50, moves a pivot pin 66 outwardly from the side member 50 and through the aperture in the plate 63 to secure the accessory unit assembly 10 to the vehicle 46. Likewise, a latch mechanism 64 on the other side member 50 of the plow mount 48 would be actuated to move the hitch pin 66 into engagement with the aperture in the plate 63. The hitch arm 65 is held in this position through use of a locking pin preferably on the cross member 54.

To release the accessory unit assembly 10 from the vehicle 46 using the remote latch mechanism 64, the respective locking pins are released so that the respective hitch arms 65 can be moved away from the respective side members 50 thus freeing the hitch pins 66 from the apertures in the respective plates 63 and enabling the accessory unit assembly 10 to be moved free of the vehicle 46.

FIG. 1 depicts the accessory unit assembly 10 with attached plow blade assembly 142 in a blade down position. In this blade down position, the lower edge of the snowplow blade 144 is either contacting the ground or is in close proximity to the ground.

Figure 2:
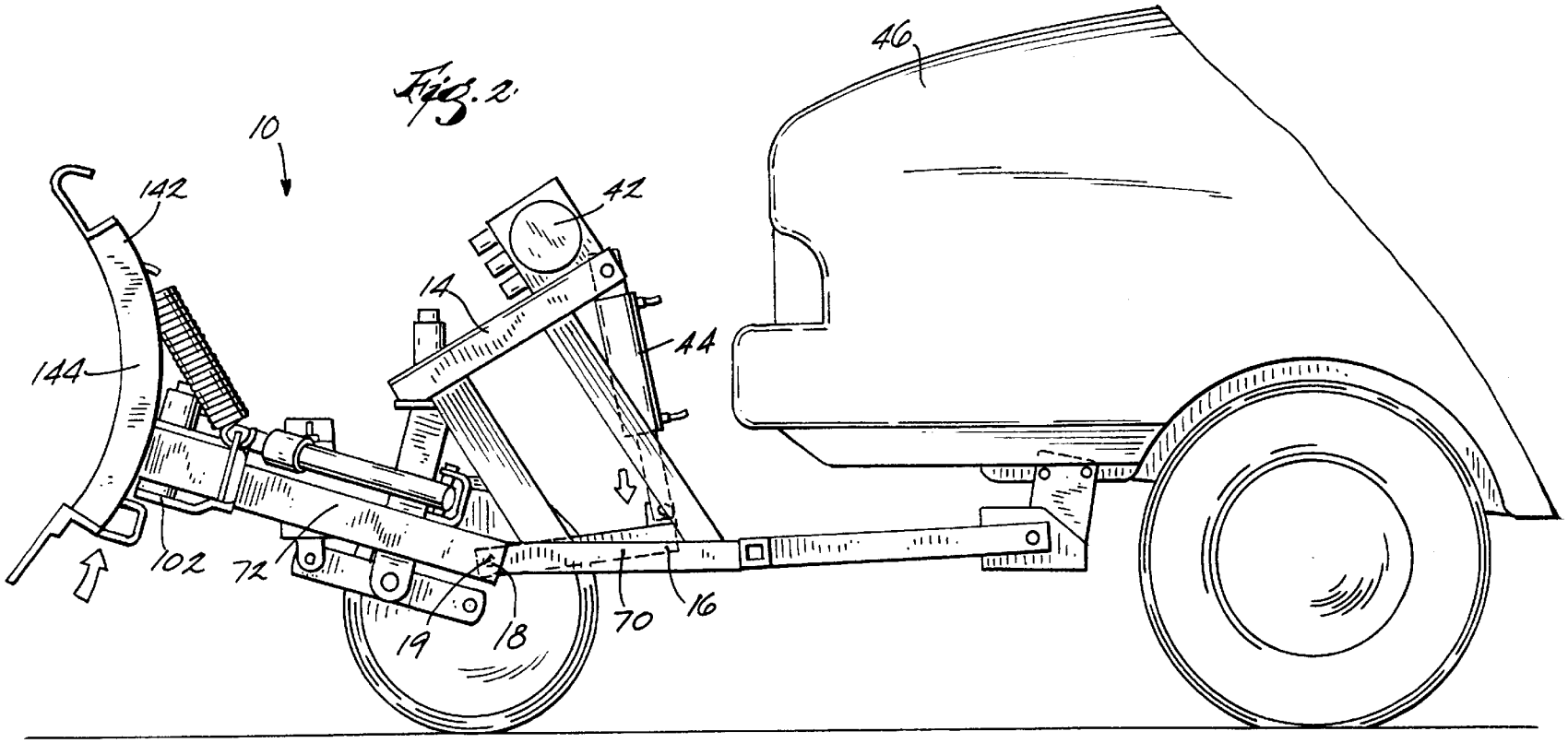
FIG. 2 is a side view of the vehicle mounted accessory assembly including the ground engaging wheel and with the attached snowplow blade in a blade up position.

When it is desired to raise the snowplow blade 144 such as when transporting the accessory unit assembly 10, when repositioning the snowplow blade 144 or when stacking snow, the snowplow blade 144 is moved to its blade up position as illustrated in FIG. 2.

With reference to FIGS. 1 and 2, the snowplow blade 144 is moved from its blade down position to its blade up position using the actuator 44. When the actuator 44 is extended by the hydraulic power unit 42 and hydraulically locked in the extended position, the actuator 44 causes the frame 70 of the pivot frame 16 to move downwardly. Due to the angled connection between the frame 70 and the frame 72 and the pivot connection between the pivot frame 16 and the carriage 14 at pivot axis 19, downward motion of the frame 70 causes upward motion of the frame 72. In turn, upward motion of the frame 72 causes upward motion of the quadrant 102 and the plow blade assembly 142 thus moving the plow blade 144 upwardly. The degree to which the blow blade 144 is raised is controlled by the degree to which the actuator 44 is extended.

With the pivot axis 19 of the accessory unit being forward of the vehicle bumper, the vehicle bumper does not limit the range of motion of the accessory unit such as snowplow blade 144. Further, with the pivot axis 19 forward and clear of the vehicle bumper, less stresses are transferred to the vehicle 46. As shown in FIG. 1, the plow blade assembly 142 is secured to the support frame 12 forward of the pivot axis 19, forward being in a direction away from the vehicle 46 as if a vertical plane intersected the pivot axis 19. The actuator 44 supported by the carriage 14 is connected to the pivot frame 16 rearward of the pivot axis 19, rearward being in a direction toward the vehicle 46 as if a vertical plane intersected the pivot axis 19.

To further minimize stresses on the vehicle, a ground engagable member such as a wheel assembly 160 is used in conjunction with the accessory unit assembly 10. Other ground engagable members such as skids could also be utilized.

In the preferred embodiment, the wheel assembly 160 is particularly shown in FIGS. 8 through 13. The wheel assembly 160 helps support the weight of the accessory unit assembly 10 during transportation on the vehicle 46 thus minimizing stress to the vehicle 46 caused by the weight of the accessory unit. Preferably, during accessory unit use, the wheel assembly 160 looses contact with the ground due to the operation of the actuator 44. Alternately, the wheel assembly 160 can maintain contact with the ground during accessory unit use.

Referring now to FIGS. 8 through 11, the wheel assembly 160 includes a ground engaging wheel 162 having an axis of rotation 164 and a hub 166. The wheel 162 is preferably highway rated such that the wheel 162 is in contact with the ground when the accessory unit is being transported on the vehicle 46. Various types of wheels can be used such as wheels rated with a high speed pneumatic tire, such as, for example, an 8×3¾ wheel with a 480×8 C rated tire from Nielsen Wheel of Milwaukee, Wis.

The wheel assembly 160 further includes a mounting assembly 168. The mounting assembly 168 includes a first mounting member and a second mounting member. The first mounting member includes a support plate 170. A king pin 172 extends upwardly from the plate 170 along an axis 171. A pair of spaced legs 174 and 176 depend from the plate 170. The legs 174 and 176 are spaced so as to enable the wheel 162 to be positioned therebetween. A generally U-shaped yoke 178 is secured to the legs 174 and 176. The yoke 178 extends outwardly from the legs 174 and 176 and includes two legs 180 and 182 and a web 184 therebetween. A first support plate 186 extends between the legs 180 and 182. A second support plate 188 extends inwardly from the leg 180 toward the leg 182. The support plate 186 has therein two apertures 190 and 192.

The second mounting member includes a pair of link arms 194 and 196. Each link arm 194 and 196 has a first end aperture 198, a second end aperture 200 and a center portion 202. The center portion 202 of the link arm 194 is pivotally connected to the leg 174 such as by a pivot pin 204 at a pivot axis 206 and the center portion 202 of the link arm 196 is pivotally connected to the leg 176 such as by a pivot pin 208 at the pivot axis 206. The first end aperture 198 of each link arm 194 and 196 is aligned with the hub 166 of the wheel 162 with a pin 210 along the axis of rotation 164. The pivot axis 206 is therefore not axially aligned with the axis of rotation 164 of the wheel 162 and is forward of the axis of rotation 164 in the direction the yoke 178 extends from the legs 174 and 176. A support member or fastener 212 such as a bolt secured with a nut extends through the spaced second end apertures 200 of the link arms 194 and 196.

Continuing to refer to FIGS. 8 through 11, the wheel assembly 160 further includes a dampener such as shock absorber 214 and a spring assembly 216 housed within the yoke 178. The shock absorber 214 is of a conventional hydraulic type such as small bore series from Arvin Ride Control of Toronto, Canada. The shock absorber 214 includes a housing 218 that is fixed to the support plate 188. The shock absorber 214 further includes a rod 220 operationally connected to the housing 218. An end 224 of the rod 220 is pivotally connected to the fastener 212 that extends between the link arms 194 and 196. The rod 220 extends through and is moveable in the aperture 192 in the support plate 186.

The spring assembly 216 is housed adjacent the shock absorber 214. The spring assembly 216 include a spring bar 226, a shaft 228 and a spring 230. The shaft 228 includes a first end 232 that is fixed to the spring bar 226. The shaft 228 extends downwardly from the spring bar 226 through the aperture 190 in the support plate 186 and is pivotally connected to the fastener 212. The spring 230 is housed between the spring bar 226 and the support plate 186 and surrounds the shaft 228. One end of the spring 230 is in contact with the spring bar 226 and the other end of the spring 230 is in contact with the support plate 186. Preferably, the spring 230 is a compression spring.

Figures 9, 10, 11:
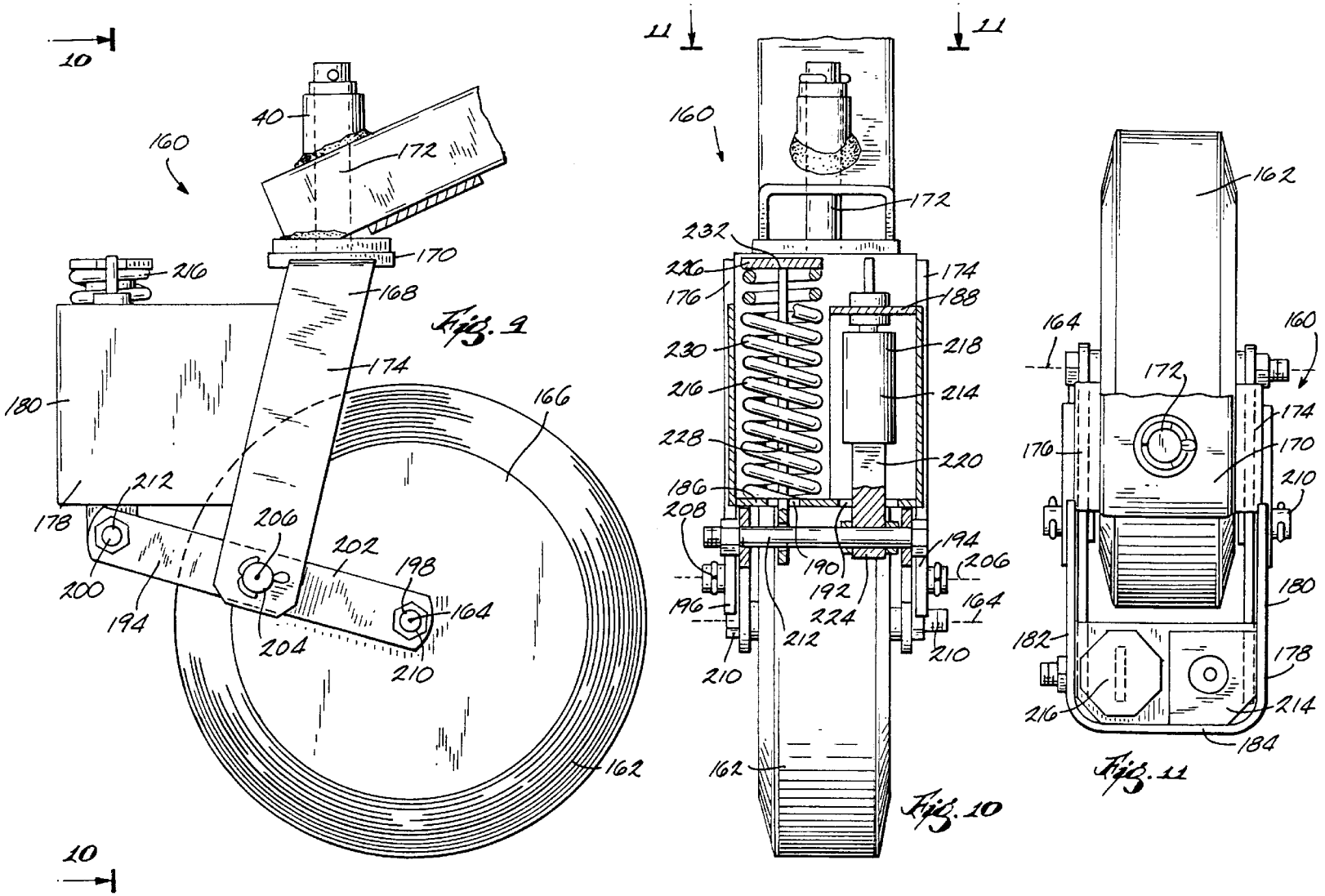
FIG. 9 is a side view of the ground engaging wheel and the wheel mounting assembly.
FIG. 10 is a view taken along line 10—10 of FIG. 9.
FIG. 11 is a view taken along line 11—11 of FIG. 10.

As best shown in FIGS. 9 and 12, to connect the wheel assembly 160 to the support frame 12 and, particularly, to the carriage 14, the king pin 172 is positioned through the bore 41 so that a portion of the king pin 172 extends upwardly from the cylindrical member 40. The king pin 172 is secured in this position, for example, using a fastener such as a cotter pin. In this orientation, the wheel assembly 160, and specifically the king pin 172, is allowed to pivot within the bore 41 along the axis 171.

In operation, the accessory unit assembly 10 and wheel assembly 160 perform as follows. When vehicle is transporting the accessory unit assembly 10 and the wheel 162 encounters an obstacle (bounce condition), the wheel 162 is forced in an upward direction. The movement of the wheel 162 in turn causes movement of the link arms 194 and 196 which pivots about the pivot axis 206 and causes the second end apertures 200 of the link arms 194 and 196 to move downwardly. When the second end apertures 200 of the link arms 194 and 196 move downwardly, the fastener 212 with rod 220 and shaft 228 pivotally connected thereto also moves downwardly. This causes the spring 230 to be compressed due to the spring bar 226 and the shaft 228 moving downwardly with the fastener 212. The fully compressed spring 230 acts as a positive stop for the wheel assembly 160 when encountering the obstacle. The shock 214 extends to dampen the bounce of the wheel 162.

When the obstacle is removed (rebound condition), the second end apertures 200 of the link arms 194 and 196 move upwardly and eventually contact the bottom of the support plate 186 and act as another positive stop. The shock 214 retracts to dampen the rebound of wheel 162.

In a preferred embodiment, a castor wheel steering dampening assembly such as king pin dampener assembly 240 is utilized. As particularly shown in FIGS. 12 and 13, the dampener assembly 240 includes a mounting block or stabilizer mount 242 and a dampener such as shock absorber 244. The stabilizer mount 242 is preferably rectangular. A mounting boss 256 extends upwardly on the mount 242 on an axis 258. The stabilizing mount 242 includes a cylindrical aperture 246. The cylindrical aperture is on an axis 260.

The stabilizer mount 242 is secured to the king pin 172 as follows. Referring particularly to FIG. 12, the king pin 172 includes a thrust washer 262. The king pin 172 is positioned in the bore 41 such that a portion of the king pin 172 extends upwardly from the cylindrical member 40. The cylindrical aperture 246 of the stabilizing mount 242 is positioned such that the king pin 172 is inserted into the cylindrical aperture 246 such that the axis 260 and the axis 171 of the king pin are axially aligned.

In this position, the stabilizing mount 242 is secured to the king pin 172 with a fastener 266 such as a screw and a flat washer and locknut. The aligned axis 260 and 171 are offset from and parallel to the axis 258 of the mounting boss 256. Preferably, the offset is along an axis 257 which is parallel to axis 164. In other words, as shown in FIG. 13, the axis 258 intersects the axis 257 either to the right or to the left of the axis 171.

Figure 13:
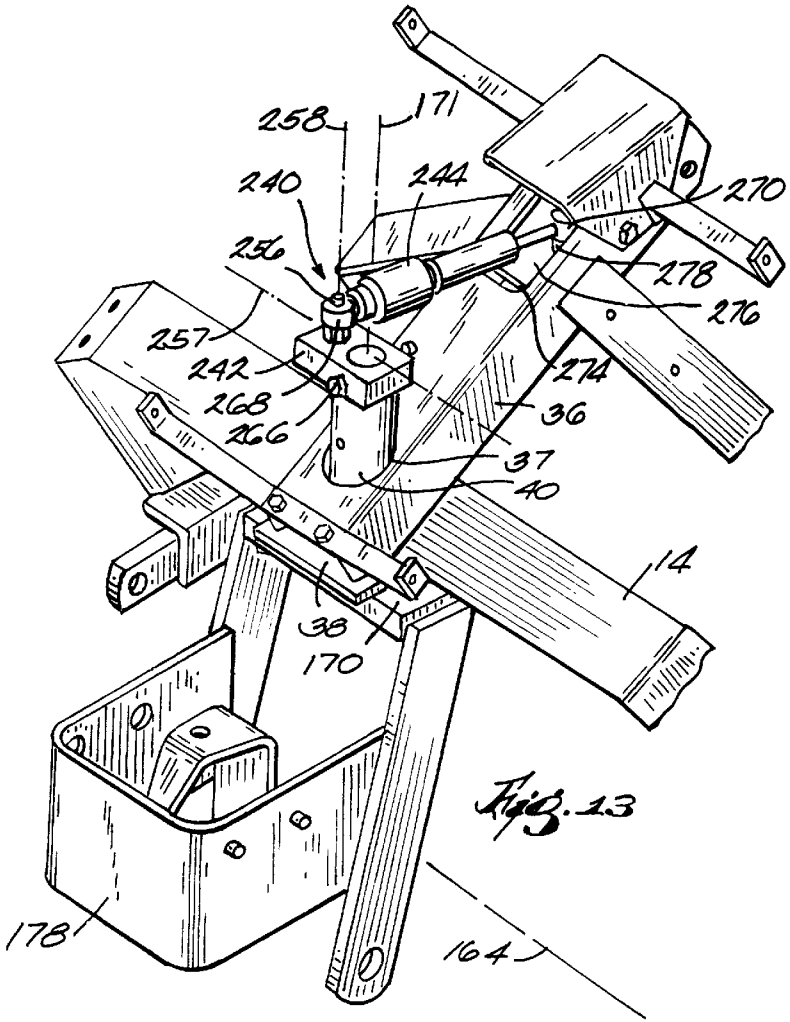
FIG. 13 is a perspective view of a portion of the carriage, the wheel mounting assembly, and a king steering dampener.

Referring now to FIG. 13, the king pin shock absorber 244 is shown. Preferably, the shock absorber 244 is a conventional shock absorber with equal compression and extension damping similar to small bore series with gas cell technology available from Arvin Ride Control of Toronto, Canada. The shock absorber 244 includes a base end 268 and a rod end 270. The base end 268 is secured to the mounting boss 256 of the stabilizing mount 242 such as with a retaining ring. The rod end 270 is pivotally connected to the support frame 12 and, more particularly, to the carriage 16. Preferably, the mounting rail 36 includes a rectangular aperture 274 spaced from the aperture 37. A mounting plate 276 is aligned with and positioned below the aperture 274. The mounting plate 276 includes an upwardly extending mounting boss 278. The rod end 270 is pivotally connected to the mounting boss 278 such as with a retaining ring.

In operation, as the king pin 172 rotates due to the rotation of the wheel assembly 160, the stabilizing mount 242 also rotates about the axis 171 of the king pin 172. As the stabilizing mount 242 rotates about the axis 171, the shock absorber 244 either extends or retracts depending upon the direction of rotation of the king pin 172 due to the offset of the axis 258 from the axis 171. Accordingly, the shock absorber 244 functions to maintain a force on the wheel assembly 160 to prevent the wheel assembly 160 from deviating from a forward aligned positioned in that a force to disalign the wheel assembly 160 has to be greater than the force of the shock absorber 244 maintaining the wheel assembly 160 in its forward aligned position.

The action of the shock absorber 244 maintains the wheel assembly 160 in forward alignment and also eliminates or minimizes oscillation by acting to maintain the wheel assembly 160 in its forward aligned position.

As a result of the two part support frame 12 and the wheel assembly 160, the weight of the accessory unit such as snowplow blade 144 pivots the frame 72 of the pivot frame 16 downwardly about a fulcrum consisting of the wheel assembly 160 thereby reducing the forces on the vehicle and urging the front end of the vehicle 46 upwardly. In the blade down position, the weight of the accessory unit assembly 10 and the wheel assembly 160 is carried by the blade which increases the downforce by up to 80%. Preferably, the wheel assembly 160 is positioned such as to be located between the center of gravity of the combined support frame 12, quadrant 102 and plow blade assembly 142 and the vehicle 46 and more specifically, located close to and in the vicinity of the center of gravity.

As a result, the weight of the accessory unit assembly 10 acts to reduce the force exerted on the front end suspension of the vehicle 46. This has the effect of reducing the wear on the vehicle's front end suspension normally associated with the attachment of a accessory unit.

With reference to FIG. 1, to reduce stress on the vehicle, the downward force $F_{HITCH}$ needs to be reduced or eliminated. The accessory unit assembly 10 through the use of the wheel assembly 160 eliminates the downward force $F_{HITCH}$. It should be noted that the accessory unit assembly 10 in the preferred embodiment eliminates the downward force $F_{HITCH}$ and exerts a slight upward force $F_{HITCH}$. Specifically, $$\Sigma M_{FHitch}=\text{Plow weight}(x+y)/y=F_{pw}.$$

As (x+y)/y decreases, the plow weight being a constant, $F_{pw}$ decreases. Further, $$\Sigma M_{Fpw}=\text{Plow weight}(x)/y=F_{hitch}.$$

As x/y decreases, the plow weight being constant, $F_{hitch}$ decreases.

The support frame 12 consisting of the carriage 14 and the pivot frame 16 and the plow mount 48 enables the vehicle mounting member 58 to be mounted further underneath the vehicle 46 in a direction away from the front bumper. With reference to FIG. 1, this reduces the forces on the vehicle 46 since the distance y is lengthened and the distance z is shortened. Therefore, the smaller the distance z, the less effect $F_{hitch}$ has on $F_{pw}$. Having the mounting member 58 able to be mounted further under the vehicle 46 enhances the aesthetics of the vehicle 46 because the mounting member 58 cannot be seen at normal eye level.

The wheel assembly 160 also facilitates movement of the accessory unit assembly 10 when detached from the vehicle 46.

For some accessory unit applications, it may be desirable to utilize two ground engaging wheels 162 that rotate about the same axis.

We claim:

1. An assembly for mounting an accessory unit to a vehicle, said assembly comprising:

a first frame adapted to be pivotally connected to the vehicle along a first pivot axis during operation of the assembly;

a second frame pivotally connected to said first frame along a second pivot axis, said second frame adapted to support an accessory unit; and an actuator for actuating pivotal movement of said second frame, said actuator operationally extending between said first frame and said second frame at a location rearward of said second pivot axis in a direction away from the vehicle.

2. The assembly of claim 1 wherein said accessory unit includes a plow blade;

said first frame comprises a carriage frame mounted for pivotal movement on said first pivot axis;

said second frame is a pivot frame pivotally connected to said carriage frame at said second pivot axis, said second pivot axis being located forward of said first pivot axis in a direction away from the vehicle;

said plow blade is supported by said pivot frame;

an actuator operationally connecting said carriage frame and said pivot frame for actuating pivotal movement of said pivot frame relative to said carriage frame; and a ground engagable member secured to said carriage frame.

3. The vehicle mountable snowplow assembly as set forth in claim 2 wherein said pivot frame supports said plow blade forward of said second pivot axis.

4. The vehicle mountable snowplow assembly as set forth in claim 2 wherein said carriage frame is adapted to be connected to the vehicle rearward of said second pivot axis.

5. The vehicle mountable snowplow assembly as set forth in claim 2 wherein said actuator extends between said carriage frame and said pivot frame.

6. The vehicle mountable snowplow assembly as set forth in claim 5 wherein said actuator extends between said carriage frame and said pivot frame at a location rearward of said second pivot axis.

7. The vehicle mountable snowplow assembly as set forth in claim 2 wherein said ground engagable member selectively engages the ground.

8. The vehicle mountable snowplow assembly as set forth in claims wherein said ground engagable member includes a wheel.

9. The vehicle mountable snowplow assembly as set forth in claim 2 wherein a portion of said carriage frame extends above said pivot frame.

10. The vehicle mountable snowplow assembly as set forth in claim 2 wherein said carriage frame includes a pair of side rails, wherein each of said side rails has a first end which is the portion of said carriage frame pivotally connected to said pivot frame and wherein each of said side rails has a second end adapted to be connected to the vehicle.

11. The vehicle mountable snowplow assembly as set forth in claim 10 wherein a pivot pin pivotally connects said pivot frame to said carriage frame.

12. The vehicle mountable snowplow assembly as set forth in claim 2 wherein said pivot frame is generally O-shaped.

13. The vehicle mountable snowplow assembly as set forth in claim 12 wherein said O-shaped pivot frame is defined by two generally C-shaped members and wherein one of said C-shaped members is at an angle relative to the other of said C-shaped members.

14. The vehicle mountable snowplow assembly as set forth in claim 2 and further including a second and third actuator and wherein each of said second and third actuators having a first end secured to said pivot frame and a second end secured to said plow blade.

15. The vehicle mountable snowplow assembly as set forth in claim 2 wherein the combination of said carriage frame, said pivot frame, said plow blade and said actuator has a center of gravity and wherein said ground engagable member is secured to said carriage frame rearward of said center of gravity.

16. The assembly as set forth in claim 1 wherein said second pivot axis is forward of said first pivot axis in a direction away from the vehicle.

17. The assembly as set forth in claim 1 wherein said second frame is adapted to support said accessory unit forward of said second pivot axis.

18. The assembly as set forth in claim 1 wherein said first frame is adapted to be pivotally connected to the vehicle rearward of said second pivot axis.

19. The assembly as set forth in claim 1 and further including a ground engagable member connected to said first frame.

20. The assembly as set forth in claim 1 wherein said ground engagable member selectively engages the ground.

21. The assembly as set forth in claim 1 wherein said ground engagable member includes a wheel.

22. The assembly as set forth in claim 2 wherein said wheel includes a mounting assembly that is securable to said first frame.

23. An assembly for mounting an accessory unit to a vehicle, said assembly comprising:

a first frame adapted to be pivotally connected to the vehicle during operation of the assembly along a first pivot axis;

a ground engageable member including a wheel and being connected to said first frame;

said ground engagable member further including a spring and dampener;

a second frame pivotally connected to said first frame along a second pivot axis, said second frame adapted to support an accessory unit; and an actuator for actuating pivotal movement of said second frame, said actuator operationally connecting said first frame and said second frame.

24. The assembly as set forth in claim 1 and further including said accessory unit connected to said second frame.

25. The assembly as set forth in claim 24 wherein said accessory unit is a snowplow.

26. The assembly as set forth in claim 1 and further including a ground engaging wheel supported by said first frame.

27. The assembly as set forth in claim 1 wherein a portion of said first frame extends above said second frame.

28. The assembly as set forth in claim 1 wherein said actuator includes a hydraulic cylinder.

29. The assembly as set forth in claim 1 wherein at least one pivot pin pivotally connects said first and second frames.

30. The assembly as set forth in claim 1 and further including a ground engagable member connected to said first frame and said accessory unit connected to said second frame, wherein the combination of said first frame, said second frame, said actuator, said accessory unit and said ground engagable member has a center of gravity, and wherein said ground engagable member is positioned in the vicinity of said center of gravity.

31. An assembly for mounting an accessory unit to a vehicle, said assembly comprising:

a support frame;

a first mounting member pivotally connected to said support frame about a generally vertical first axis;

a second mounting member connected to said first mounting member;

a ground engagable wheel connected to said second mounting member;

a spring operationally connected to said first and second mounting members; and a dampener operationally connected to said first and second mounting members.

32. The assembly as set forth in claim 31 wherein said dampener is a shock absorber.

33. The assembly as set forth in claim 31 wherein said spring is a compression spring.

34. The assembly as set forth in claim 31 wherein said second mounting member is pivotally connected to said first mounting member along a second axis.

35. The assembly as set forth in claim 34 wherein said ground engagable wheel is connected to said second mounting member at a third axis and wherein said second and third axis are parallel.

36. The assembly as set forth in claim 31 wherein said first mounting member is removably connected to said support frame.

37. The assembly as set forth in claim 31 wherein said second mounting member limits the range of motion of said wheel by contacting said first mounting member.

38. The assembly as set forth in claim 31 wherein said spring limits the range of motion of said wheel.

39. The assembly as set forth in claim 31 wherein said first mounting member includes a king pin and wherein said first mounting member is secured to said support frame with said king pin.

40. The assembly as set forth in claim 31 wherein said first mounting member includes a pair of legs spaced such that said wheel is positionable between said legs and wherein said second mounting member includes a pair of link arms, each link arm having a first and a second end and each link arm is pivotally connected to one of said legs.

41. The assembly as set forth in claim 40 wherein said first mounting member further includes a yoke secured to said pair of legs and wherein said spring and said dampener are housed within said yoke.

42. The assembly as set forth in claim 31 wherein said second mounting member includes a support member and wherein said spring and said dampener are operationally connected to said support member.

43. The assembly as set forth in claim 40 wherein said wheel has an axis of rotation and wherein each first end of said link arms is pivotally connected to said wheel at said axis of rotation.

44. The assembly as set forth in claim 40 wherein said legs are pivotally connected to said link arms between said first end and said second end of said link arms.

45. The assembly as set forth in claim 31 and further including a shaft positioned such that said spring surrounds said shaft, said shaft having a first end pivotally connected to said second mounting member whereby movement of said shaft compresses said spring.

46. The assembly as set forth in claim 31 wherein said dampener includes a first end pivotally connected to said second mounting member.

47. An assembly for mounting an accessory unit to a vehicle, said assembly comprising:

a support frame adapted to be removably secured to a vehicle;

a mounting member pivotally connectable to said support frame about a generally vertical first axis and rotatable about said axis through 360 degrees;

a wheel secured to said mounting member and adapted to engage the ground; and a dampener connected to said support frame and said mounting member so as to dampen the rotational movement of said mounting member with respect to said support frame.

48. The assembly as set forth in claim 47 wherein said mounting member includes a king pin rotatable about said axis.

49. The assembly as set forth in claim 47 wherein said dampener is a shock absorber.

50. The assembly as set forth in claim 47 wherein said dampener has a first end connected to said support frame at a second axis and wherein said second axis is parallel to said first axis.

51. The assembly as set forth in claim 47 wherein said dampener has a second end operationally connected to said mounting member at a third axis and wherein said third axis is parallel to said first axis.

52. The assembly as set forth in claim 51 wherein said wheel rotates about a fourth axis and wherein said third axis is offset from said first axis in a direction parallel to said fourth axis.

53. A castor wheel steering dampening assembly comprising:

a support frame;

a mounting member pivotally connectable to said support frame about a generally vertical first axis and rotatable about said axis through 360 degrees;

a wheel secured to said mounting member and adapted to engage the ground; and a dampener connected to said support frame and said mounting member so as to dampen the rotational movement of said mounting member with respect to said support frame.

* * * * *

UNITED STATES PATENT AND TRADEMARK OFFICE

CERTIFICATE OF CORRECTION

PATENT NO. : 6,050,008
DATED : April 18, 2000
INVENTOR(S) : James R. Doornek, et. al.

It is certified that error appears in the above-indentified patent and that said Letters Patent is hereby corrected as shown below:

Claim 8, column 10, line 49, delete "claims" and insert --claim 2--.

Claim 20, column 11, line 27, delete "claim 1" and insert --claim 19--.

Claim 21, column 11, line29, delete "claim 1" and insert --claim 19--.

Claim 22, column 11, line 31, delete "claim 2" and insert --claim 21--.

Signed and Sealed this

Tenth Day of April, 2001

*Attest:*

Nicholas P. Godici

NICHOLAS P. GODICI

*Attesting Officer*

*Acting Director of the United States Patent and Trademark Office*